United States Patent [19]

Smyth

[11] 4,316,170

[45] Feb. 16, 1982

[54] SELECTOR FUSE

[76] Inventor: Edgar H. Smyth, Box 49245, Chicago, Ill. 60649

[21] Appl. No.: 122,236

[22] Filed: Feb. 15, 1980

[51] Int. Cl.[3] ..... H01H 85/22

[52] U.S. Cl. ..... 337/257; 337/259

[58] Field of Search ..... 337/257, 258, 259, 260, 337/256, 261

[56] References Cited

U.S. PATENT DOCUMENTS

| | | | |
|---|---|---|---|
| 1,505,464 | 8/1924 | Horner | 337/257 |
| 1,994,895 | 3/1935 | Moss | 337/257 |
| 2,284,600 | 5/1942 | Altschule | 337/257 |
| 2,650,968 | 9/1953 | Wilson | 337/259 |

*Primary Examiner*—Harold Broome

*Attorney, Agent, or Firm*—Paul H. Gallagher

[57] ABSTRACT

A selector fuse to be used in an ordinary fuse socket, having a cup-shape body with an exterior screw threaded sheath thereon. A plurality of (3) contact fuse members in the interior are connected with the sheath. A rotatable shaft has a contact finger engaging the fuse members successively upon rotation of the shaft. The fuse members are spring biased radially inwardly, and yieldingly maintain engagement with the finger, and have detent formations yieldingly holding the shaft in set position. Additionally, the fuse members are so shaped as to block reverse rotation of the shaft. The fuse members may be of different, or the same, fusing values, as desired.

5 Claims, 6 Drawing Figures

SELECTOR FUSE

OBJECTS OF THE INVENTION

A broad object of the invention is to provide a selector fuse or fuse plug having a plurality of fuse members that can be selectively put in circuit, which is extremely simple and correspondingly inexpensive, and unusually reliable.

More specifically, the device is of such simple design and construction as to be readily adapted to mass production, and certain parts thereof particularly adapted to machine production.

DESCRIPTION OF A PREFERRED EMBODIMENT

Figure 3:
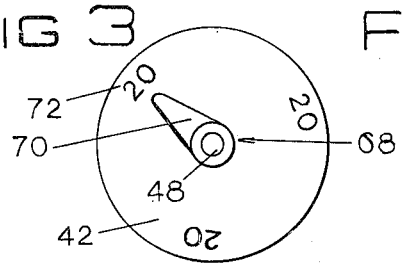
FIG. 3 is a top view of the fuse showing indicia of fusing values thereon.

Referring in detail to the drawings, the selector fuse or fuse plug of the invention includes a fuse body, or casing, or shell, 10 generally cup shaped and made of suitable and known material, ordinarily used in the manufacture of fuses, such as glass or porcelain. The body includes a cylindrical wall 12 and a floor or bottom element 14 preferably conical-shaped. Surrounding the cylindrical wall 12 is a sheath or sleeve 16 of suitable metal, such as copper, for good electrical conduction, and is secured to the fuse body in any known manner. This sheath is provided with the usual threads 18 for threading the fuse into the fuse socket.

At a suitable location on the cylindrical wall 12 is a band or belt 20 preferably set in a groove 22 so as to be flush with the outside surface of the wall. This band is also of conductive material, such as copper. The sheath 16 engages the band 20 for contact engagement therewith and may be soldered or spot welded thereto as indicated at 24.

Figure 2:
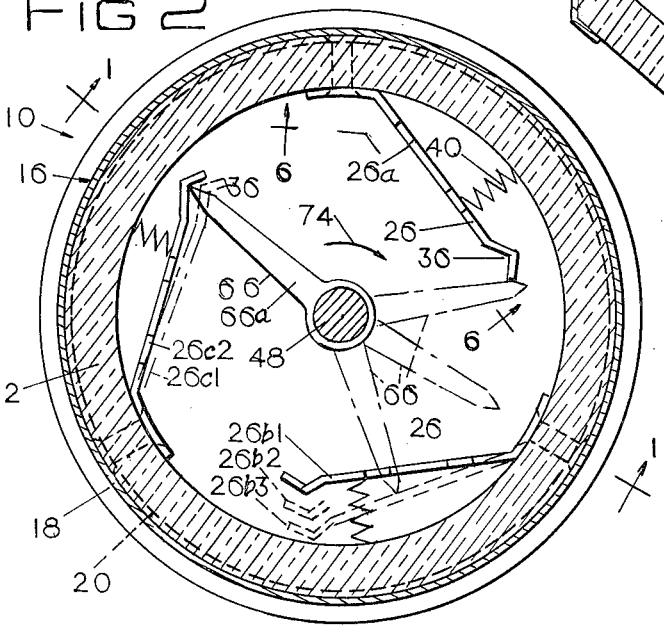
FIG. 2 is a transverse sectional view taken at line 2—2 of FIG. 1.
Figure 6:
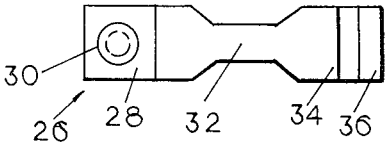
FIG. 6 is a developed view taken at line 6—6 of FIG. 2.

Mounted in the cup-shaped body are a plurality of fuse members 26 shown in detail in FIG. 6. These fuse members, or contact members 26 are all generally similar in construction, but in one case may be of different fusing values as referred to hereinbelow. Each fuse member has a base portion 28 having an aperture 30, an intermediate portion 32 forming a fusable element, and an outer portion 34 forming a V notch 36 facing radially inwardly and serving as a detent as referred to again hereinbelow. The fuse members 26 are secured in place with their base portions 28 fitted to the wall 12 and rivets 38 extending through the band 20, the wall 12, and the fuse members. The opposite ends of the fuse members, i.e., the portions 34, are free and are biased radially inwardly by compression springs 40 (FIG. 2).

The upper end of the fuse body 10 is closed by a cover 42 which is preferably of insulating material, for safety purposes, having a down-turned flange 44 fitted over an upwardly diverging enlargement 46 of the fuse body, and held in place thereby.

A central shaft 48 is rotatably mounted in the fuse body, in the cover 42 and in a pair of discs 50, these discs being made of suitable material, insulating material or otherwise, the discs being fitted in place in the body in a suitable manner, such as by press fitting.

The shaft 48 is of conductive material and secured thereto at the lower end as by welding, is a compression spring 52 also welded to a washer 54, the washer being constantly biased, by the compression spring 52, against a contact insert 56, which has a head 58, and a shank 60. The insert 56 is fitted in place by extending the shank 60 through the aperture 61 in the fuse body and secured thereto by a suitable washer 62. The lower end of the shank 60 forms a contact element 64 that engages a corresponding contact in the fuse socket in which the fuse is to be used.

Mounted on the shaft 48 is a finger 66 of electrically conductive material, and conductively secured to the shaft. Upon rotation of the shaft 48 this finger sweeps around, and successively engages the contact members 26 as referred to again hereinbelow.

The circuit through the fuse socket, established by the selector fuse of the invention, leads from a corresponding contact element in the fuse socket, to the sheath 16, the band 20, rivets 38, contact members 26 (one of them at a time), the finger 66, the shaft 48, spring 52, washer 54, insert 56 which terminates in the contact end element 64 which in turn engages the counterpart contact element in the fuse socket.

Figure 4:
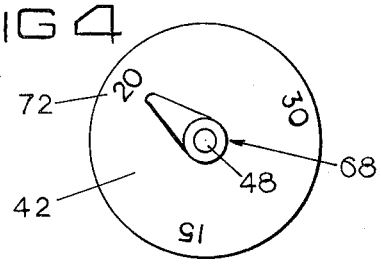
FIG. 4 is a view similar to FIG. 3 but with different fusing values indicated.

The shaft 48 is secured against axial movement outwardly, or upwardly, by a washer 67 secured on the shaft in a suitable manner, and engaging the under surface of the cover 42. A knob or actuating handle 68 is secured to the outer or upper end of the shaft 48 in a suitable manner, this knob being made of plastic or other electrically insulating material. One end of the knob 68 includes a pointer 70 for cooperation with indicia 72 which in this case is the numeral "20", indicating a value of 20 amps, (FIGS. 3 and 4). These indicia are placed in register with the fuse members 26 to indicate both the fusing value of the fuse members, and the circumferential positioning of the latter, the latter relationship being indicated by the pointer 70 in relation thereto.

The foregoing indicia of 20 amps. (FIG. 3) may be desired in the case of a domestic or regular-use installation where any positioning of the fuse, establishing a 20-amp. value, is suitable after a previous blowing step has occurred, within the safety scope of the 20 amps.

The fuse may be used also in a laboratory, where under controlled conditions it may be desired to have different valuesettings such as 15 amps, 20 amps, 30 amps, etc. FIG. 4 indicates such an arrangement and in this arrangement the fuse members 26 would be of correspondingly different values and the user may set the fuse at the position for a desired one of the values provided for a particular test, and for another test where a different value is desired, he may set the fuse at position for that different value.

Figure 5:
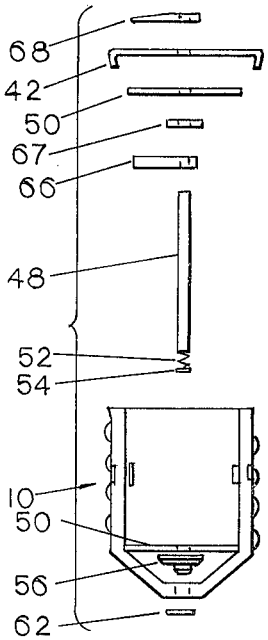
FIG. 5 is an exploded view of the parts of the selector fuse, devoid of details, indicating the order of assembling the parts to form the completed fuse.
Figure 1:
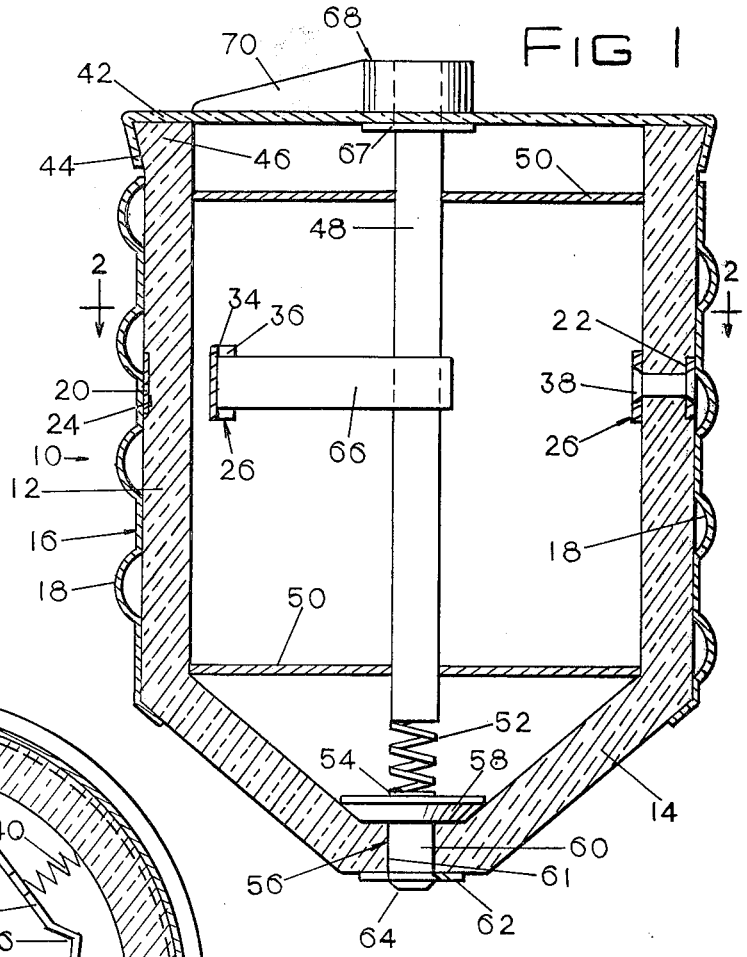
FIG. 1 is an axial sectional view of the selector fuse made according to the present invention, and taken at line 1—1 of FIG. 2.

FIG. 5 diagrammatically indicates the steps in assembling the parts or elements of the selector fuse plug. The lower disc 50 would be inserted before the contact members 26 because of the protrusion of the latter, and the insert 56 before the disc. This relationship is represented by that disc and insert being shown within the body and the washer 62 below the body which is fitted on the shaft 60 after the insert is put in place. Thereafter the remaining parts of the fuse are assembled in the relation indicated in FIG. 5 according to their positioning proceeding upwardly from the fuse body.

FIG. 2 shows to good advantage the positioning of the fuse members 26. These members are indicated generically at 26, and each individually by the postscripts a, b, c, and positions of the different fuse members with the additional postscripts 1, 2, 3. Fuse member 26*a* is shown in full lines in its position biased fully inwardly by the compression spring 40. The contact finger 66 is of such length that it must engage the fuse members as it sweeps, the finger being shown in full lines at 66*a* which is an operative position, and in this position the finger extends into the V notch 36 of the fuse member 26*c*. This fuse member is in an intermediate position, namely 26*b*2. At the lowermost portion of FIG. 2 the fuse member 26*b* is shown in full lines in its innermost position 26*b*1, and at its outermost position at 26*b*3. As the finger 66 sweeps, in clockwise direction as indicated by the arrow 74, it engages the fuse member at an intermediate position along the length of the latter and moves it to its outermost position 26*b*3. Then as the finger sweeps further, it moves into the V notch 36 and that position of the fuse member is indicated at 26*b*2, and also at 26*c*2. Thus since the fuse member is outwardly of its extreme innermost position, it will always be biased against the finger, by the spring 40. The V notch thereby serves as a detent to yieldingly hold the finger 66 in place.

In the radially innermost position of the fuse members as indicated particularly at 26*a* the free end thereof is engaged by the finger 66 and this blocks reverse rotation of the shaft and finger.

The V notch provides the dual purpose of indicating by the feel or click, that the selector knob and the shaft are in a desired position, i.e., fully and properly engaging a fuse member, and indicating that it is engaging the desired one of the fuse members according to the indication in the indicia 72.

I claim:

1. A selector fuse plug comprising, a main cup-shape body of insulating material, an external sheath on the body, of electrical conducting material, and forming threads for threading the fuse plug into a fuse socket, a plurality of fuse members in the interior of the fuse body and in electrical contact with the sheath, an end contact element on the closed end of the body, exposed exteriorly and interiorly thereof, a rotatable shaft in the fuse body having an end in constant engagement with the end contact element, and a radial finger engageable with the fuse members successively in response to rotation of the shaft, the shaft establishing electrical conduction between the particular fuse member engaged by its finger and the end contact element, the shaft having a first direction of rotation and the extended end of the radial finger moving through a predetermined ambit, and the fuse members being constituted by spring fingers fixedly secured at one end in the wall of the body and having a free end extending generally circumferentially in said first direction of rotation, and projecting within said ambit, whereby the outer end of the radial finger necessarily engages each fuse member upon rotation of the shaft, and the fuse members yield pursuant to rotational engagement by the radial finger but are biased into constant engagement with the radial finger.

2. A fuse plug according to claim 1 wherein, the fuse members have detent shape elements receiving the extended end of the radial finger and yieldingly holding the radial finger, and thus the shaft, in selected position.

3. A fuse plug according to claim 1 wherein, the fuse members are so positioned when in their unengaged position, and are so shaped at their free ends, that they prevent rotation of the shaft in direction opposite to its said first direction.

4. A fuse plug according to claim 1 wherein, the fuse members are of different fusing values, whereby to render the fuse plug operable at selectively different fusing values.

5. A selector fuse plug comprising, a main cup-shape body of insulating material, an external sheath on the body, of electrical conducting material, and forming threads for threading the fuse plug into a fuse socket, a plurality of fuse members in the interior of the fuse body and in electrical contact with the sheath, the fuse members being in the form of spring fingers having one end secured to the interior surface of the fuse body, and having a component of projection radially inwardly, an end contact element on the closed end of the body, exposed exteriorly and interiorly thereof, a rotatable shaft in the fuse body having an end in constant engagement with the end contact element, and a radial finger engageable with the fuse members successively in response to rotation of the shaft, the shaft establishing electrical conduction between the particular fuse member engaged by its finger and the end contact element, the body having a uniform-diameter inner surface terminating in an open top, a pair of axially spaced, centrally apertured transverse discs positioned in the body in detached relation therein and held by friction therein, the discs being positioned on respectively axially opposite sides of the radial finger, and operative for retaining the shaft in central axial position, a centrally apertured cover closing the open end of the body and friction-held in place thereon, the shaft extending through the apertures in the cover and discs, a knob secured to the shaft exteriorly of the cover for manual manipulation, and the cover being provided with indicia cooperative with the knob for indicating the selected one of the fuse members with which the radial finger is in engagement.

* * * * *